US008002376B2

(12) United States Patent
Kakutani

(10) Patent No.: US 8,002,376 B2
(45) Date of Patent: Aug. 23, 2011

(54) PRINTING DEVICE AND PRINTING METHOD

(75) Inventor: Toshiaki Kakutani, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 190 days.

(21) Appl. No.: 12/383,644

(22) Filed: Mar. 26, 2009

(65) Prior Publication Data

US 2009/0244168 A1 Oct. 1, 2009

(30) Foreign Application Priority Data

Mar. 26, 2008 (JP) ..... 2008-079644

(51) Int. Cl.
*B41J 2/205* (2006.01)

(52) U.S. Cl. ..... 347/15; 347/43

(58) Field of Classification Search ..... 347/100, 347/14, 43, 21, 15, 40; 358/1.2, 1.9
See application file for complete search history.

(56) References Cited

FOREIGN PATENT DOCUMENTS

JP 2006-050347 2/2006

*Primary Examiner* — Lamson D Nguyen

(74) *Attorney, Agent, or Firm* — Nutter McClennen & Fish LLP; John J. Penny, Jr.

(57) ABSTRACT

Provided is a printing device which prints an image using a metallic ink and a color ink, the device including: an input unit which inputs image data; a metallic dot formation unit which forms dot concentration dots on a printing medium using the metallic ink; and a color print unit which prints the image indicated by the image data using the color ink on the printing medium on which the dots using the metallic ink are formed.

12 Claims, 9 Drawing Sheets

FIRST EXAMPLE

SECOND EXAMPLE

THIRD EXAMPLE

FOURTH EXAMPLE

FIFTH EXAMPLE

SIXTH EXAMPLE

SEVENTH EXAMPLE

EIGHTH EXAMPLE

EXAMPLE OF COLOR INK DISPERSION TYPE

EXAMPLE OF COLOR INK CONCENTRATION TYPE

PRINTING DEVICE AND PRINTING METHOD

BACKGROUND

1. Technical Field

The present invention relates to a technology of printing an image using a metallic ink and a color ink.

2. Related Art

In an electrophotographic field, a technology of forming a solid layer using a metallic toner with respect to a region, in which a metallic color is specified, of image data and forming a process color toner layer thereon with high precision or sparsely is suggested (JP-A-2006-50347). In this technology, metallic colors of various color tones are reproduced by printing the process color toner so as to be superposed on the metallic toner.

However, for example, in an ink jet printer field, in the case where printing using the metallic ink is performed, if a pigment-based color ink is printed on a printing region formed by the metallic ink, glossy feeling deteriorates. In addition, if a dye-based color ink is printed on the metallic ink, the ink is hardly fixed and color development deteriorates.

SUMMARY

An advantage of some aspects of the invention is that color development of each color is improved when printing using a metallic ink and a color ink is performed.

The invention is to solve at least a portion of the above-described problems and can be realized as the following aspects.

According to an aspect of the invention, a printing device which prints an image using a metallic ink and a color ink, the device including: an input unit which inputs image data; a metallic dot formation unit which forms dot concentration dots on a printing medium using the metallic ink; and a color print unit which prints the image indicated by the image data using the color ink on the printing medium on which the dots using the metallic ink are formed.

According to this printing device, the dot concentration types dots (hereinafter, referred to as "metallic dots") are formed on the printing medium by the metallic ink. Accordingly, the printing medium is exposed as the base between the metallic dots. As a result, although the image is printed using the color ink on the printing medium on which the metallic dots are formed, the dots using the color ink are formed in the base portion. Accordingly, according to the printing device in the above state, it is possible to suppress the color development of the color ink or the glossy feeling of the metallic color and suppress the deterioration of the scratch resistance of the color ink.

In the printing device, the metallic dot formation unit may print halftone dots as the dot concentration dots. By such a printing device, it is possible to form the metallic dots having a halftone dot shape.

In the printing device, the metallic dot formation unit may print dots having green noise characteristics as the dot concentration dots. By such a printing device, since the metallic dots having the green noise characteristics are formed on the printing medium, it is possible to suppress the generation of a periodical shape in the metallic region due to the mechanistic factor of the printing device or the generation of moiré due to a relationship with the color region.

In the printing device, the metallic dot formation unit may change the size of each of the dot concentration dots according to a predetermined condition. In such a printing device, it is possible to properly adjust the size of each of the metallic dots.

In the printing device, the metallic dot formation unit may change the size of each of the dot concentration dots according to the color tone of the color ink printed at position where the dots are formed. In such a printing device, it is possible to flexibly adjust the color development both the color ink and the metallic ink.

The printing device, the metallic dot formation unit may form the dot concentration dots at a predetermined gap therein. In such a printing device, although the gap is present in the metallic dots, the gap can be embedded by the dot gain of the metallic ink. Accordingly, it is possible to reduce the use amount of metallic ink and suppress the overflow or bleeding of the metallic ink.

In the printing device, the metallic dot formation unit may form the dot concentration type dots by ejecting ink droplets of the metallic ink on the printing medium. As such a printing device, for example, an ink jet printing device is applicable.

The invention may be embodied as a printing method or a computer program in addition to the above-described printing device. Such a computer program may be recorded in a computer-readable recording medium. As the recording medium, for example, various media such as a flexible disc, a CD-ROM, a DVD-ROM, a magnetooptical disc, a memory card, a hard disc or the like may be used.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the embodiments of the invention will be described in following order.

A. Outline of Embodiment:

B. Device Configuration:

C. Printing Process:

D. Examples of Dot Concentration Type Metallic Dot:

E. Printing Example of Color Ink:

A. OUTLINE OF EMBODIMENT

Figure 1:
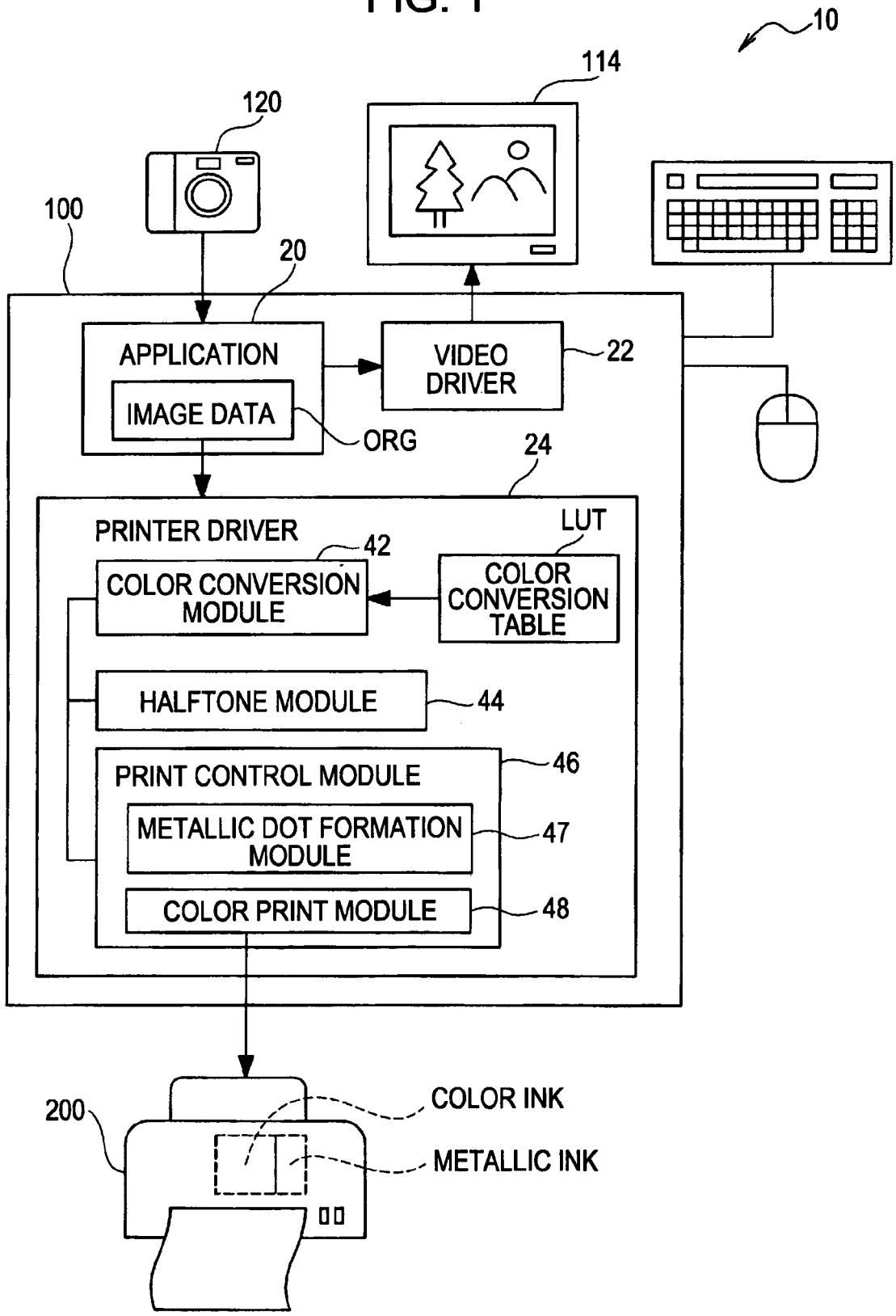
FIG. 1 is a view showing the schematic configuration of a printing system 10.

FIG. 1 is a block diagram showing the schematic configuration of a printing system 10 according to an embodiment of the invention. As shown, the printing system 10 according to the present embodiment includes a computer 100 as a print control device and a printer 200 for actually printing an image under the control of the computer 100. The printing system 10 functions as a broadly-defined printing device, of which the whole is integrally formed.

In the printer 200 of the present embodiment, a cyan ink, a magenta ink, a yellow ink and a black ink are included as a color ink, and a glossy metallic ink is further included. As the metallic ink, for example, an ink composition containing a pigment, an organic solvent, a fixing resin, and, as a pigment, using a metal foil piece having an average thickness of 30 nm or more and 100 nm or less, a 50% volume-average particle diameter of 1.0 μm or more and 4.0 μm or less, and a maximum particle diameter in particle size distribution of 12 μm or less may be used. In the present embodiment, a "color ink" includes a black ink.

In the computer 100, a predetermined operating system is installed, and an application program 20 is operated by this operating system. In the operating system, a video driver 22 or a printer driver 24 is assembled. The application program 20 inputs image data ORG from a digital camera 120, for example, via a peripheral interface 108. Then, the application program 20 displays an image displayed by the image data ORG on a display 114 via the video driver 22. In addition, the application program 20 outputs the image data ORG to the printer 200 via the printer driver 24. The image data ORG received from the digital camera 120 by the application program 20 is data including three color components of red (R), green (G) and blue (B).

The application program 20 of the present embodiment may specify a region having a metallic color (hereinafter, referred to as a "metallic region") in addition to a region having color components of R, G and B (hereinafter, referred to as a "color region"), with respect to any region in the image data ORG. The metallic region and the color region may be superposed. That is, the respective regions may be specified such that the metallic color is used as a background color and the color image is formed thereon.

A color conversion module 42, a halftone module 44 and a print control module 46 are included in the printer driver 24. Among them, the print control module 46 includes a metallic dot formation module 47 and a color print module 48.

The color conversion module 42 converts the color components R, G and B of the color region of the image data ORG into color components (cyan (C), magenta (M), yellow (Y) and black (K)) which can be represented by the printer 200, according to a color conversion table LUT which is prepared in advance.

The halftone module 44 performs a halftone process of representing gradation of image data color-converted by the color conversion module 42 by a dot distribution. In the present embodiment, a known systematic dither method is used this halftone process. Alternatively, as the halftone process, in addition to the systematic dither method, an error diffusion method, a concentration pattern method or the other halftone techniques may be used.

The print control module 46 rearranges the data arrangement of the halftone-processed image data in transmission order to the printer 200 and outputs the data to the printer 200 as printing data. In addition, the print control module 46 outputs various commands such as a print start command or a print end command to the printer 200 so as to control the printer 200.

In the present embodiment, the print control module 46 includes the metallic dot formation module 47 and the color print module 48. The metallic dot formation module 47 forms a dot concentration type metallic dot in the metallic region specified by the application program 20. Meanwhile, the color print module 48 performs the formation of the dots using the color ink, with respect to the halftone-processed image, that is, the image of the color region.

B. DEVICE CONFIGURATION

Figure 2:
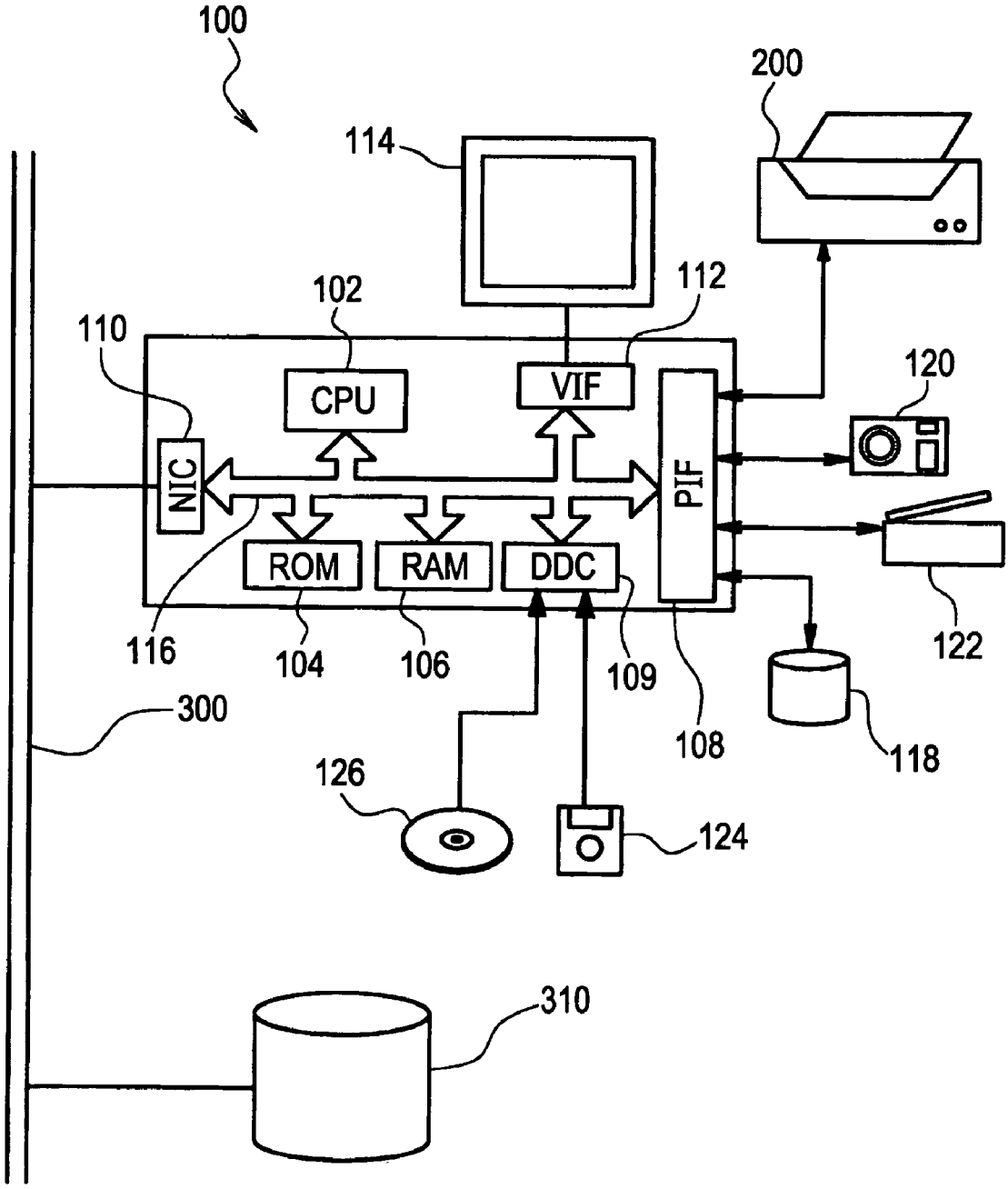
FIG. 2 is a view showing the configuration of a computer 100.

FIG. 2 is a view showing the configuration of the computer 100 as the print control device. The computer 100 is a known computer which is configured by connecting a CPU 102, a ROM 104 or a RAM 106, and so on by a bus 116.

A disc controller 109 for reading data of a flexible disc 124, a compact disc 126 or the like, a peripheral interface 108 for transmitting or receiving data to or from a peripheral, and a video interface 112 for driving the display 114 is connected to the computer 100. The printer 200 or a hard disc 118 is connected to the peripheral interface 108. When the digital camera 120 or a color scanner 122 is connected to the peripheral interface 108, an image process may be performed with respect to an image captured by the digital camera 120 or the color scanner 122. When a network interface card 110 is mounted, the computer 100 may be connected to a communication line 300 and data stored in a storage 310 connected to the communication line 300 may be acquired. When image data to be printed is acquired, the computer 100 controls the printer 200 by the operation of the above-described printer driver 24 such that the image data is printed.

Figure 3:
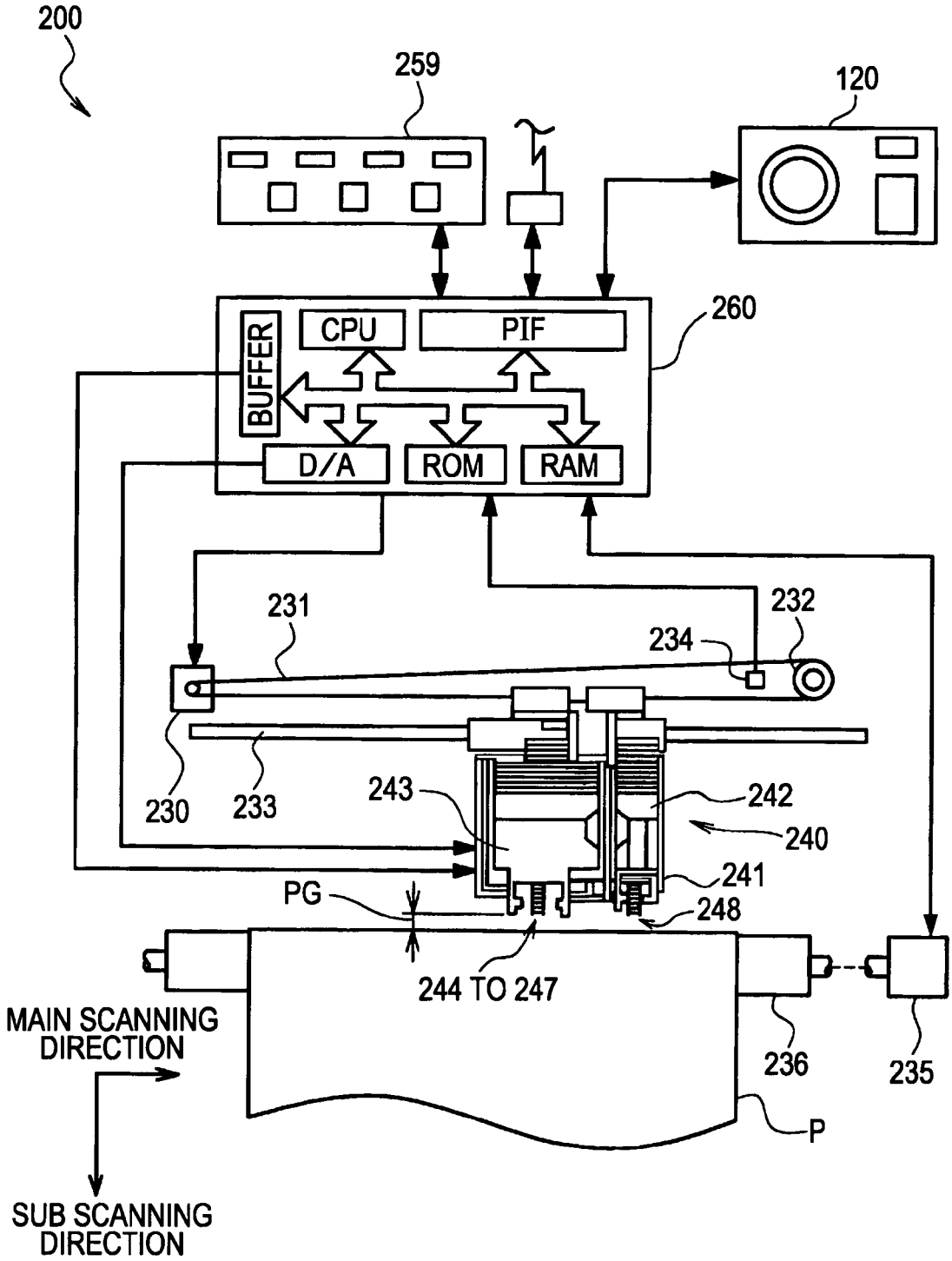
FIG. 3 is a view showing the configuration of a printer 200.

Next, the configuration of the printer 200 will be described with reference to FIG. 3. As shown in FIG. 3, the printer 200 includes a mechanism for transporting printing medium P by a paper sheet motor 235, a mechanism for reciprocally moving a carriage 240 by a carriage motor 230 in an axial direction of a platen 236, a mechanism for driving a printing head 241 mounted in the carriage 240, ejecting an ink, and forming dots, and a control circuit 260 for managing the signal transmission/reception of the paper feed motor 235, the carriage motor 230, the printing head 241 and an operation panel 256.

The mechanism for reciprocally the carriage 240 in the axial direction of the platen 236 includes a sliding shaft 233 which is bridged in parallel to the shaft of the platen 236 and slidably holds the carriage 240, a pulley 232 on which an endless driving belt 231 is stretched with the carriage motor 230, a position detection sensor 234 for detecting an original point position of the carriage 240, and so on.

In the carriage 240, a color ink cartridge 243 containing a cyan ink (C), a magenta ink (M), a yellow ink (Y) and a black ink (K) as the color ink is mounted. In the carriage 240, a metallic ink cartridge 242 containing a metallic ink (S) is mounted. In the printing head 241 located under the carriage 240, a total of five types of ink ejection heads 244 to 248 corresponding to these colors are formed. If these ink cartridges 242 and 243 are mounted in the carriage 240 from the upper side, the supply of the inks from the cartridges to the ejection heads 244 to 248 is possible.

In the control circuit 260 of the printer 200, the CPU, the ROM, the RAM, the PIF (peripheral interface) and so on are connected by the bus, and a main scanning operation and a sub scanning operation of the carriage 240 are controlled by controlling the operations of the carriage motor 230 and the paper feed motor 235. When printing data output from the computer 100 is received via the PIF, driving signals according to the printing data are applied to the ink ejection heads 244 to 248 according to the main scanning or sub scanning movement of the carriage 240 such that these heads can be driven.

The printer 200 having the above-described hardware configuration reciprocally moves the ink ejection heads 244 to 247 of the respective colors with respect to the printing medium P in a main scanning direction by driving the carriage motor 230, and moves the printing medium P in a sub scanning direction by driving the paper feed motor 235. The control circuit 260 drives nozzles at appropriate timings based on the printing data according to the reciprocal movement (main scanning) of the carriage 240 or the paper feed movement (sub scanning) of a printing medium so as to form ink dots of appropriate colors at appropriate positions on the printing medium P. Accordingly, the printer 200 can print a color image on the printing medium P.

Although the printer 200 of the present embodiment is described as a so-called ink jet printer for ejecting ink droplets to the printing medium so as to form ink dots, a printer for forming dots using any method may be used. For example, instead of the ink droplets, the invention is suitably applicable to a printer for attaching toner powders of respective colors to a printing medium using static electricity so as to form dots or a line printer.

C. PRINTING PROCESS

Subsequently, a printing process executed by the computer 100 by the operation of the printer driver 24 will be described.

Figure 4:
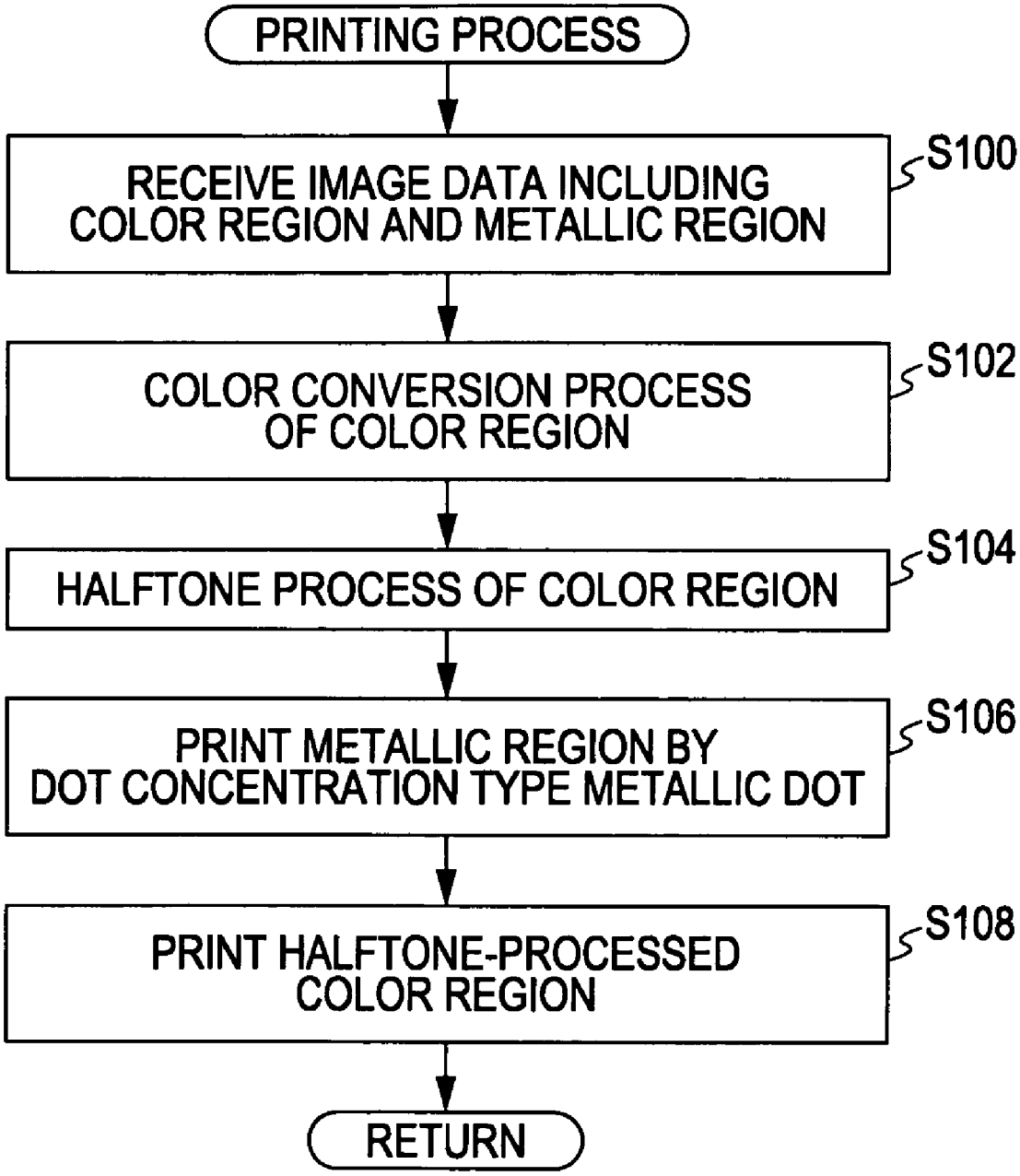
FIG. 4 is a flowchart showing a printing process.

FIG. 4 is a flowchart showing a printing process according to the present embodiment. If the printing process is started, the computer 100 receives image data, in which the metallic region and the color region are specified, from the application program 20 by the printer driver 24 (step S100).

When the image data is received, the computer 100 converts the image data of an RGB format into image data of a CMYK format, with respect to the color region of the image data (step S102). When the image data of the CMYK format is obtained, the computer 100 performs a halftone process using the halftone module 44 and generates data which can be transmitted to the printer 200 (step S104).

Subsequent to the halftone process, the computer 100 controls the printer 200 by the metallic dot formation module 47 and performs printing of the metallic region included in the image data received in the step S100 (step S106). At this time, the computer 100 forms a dot concentration type metallic dot in the metallic region such that a base portion (printing medium) in the metallic region is exposed. The detailed example of the dot concentration type metallic dot will be described in the below-described example.

When the printing of the metallic region is finished, lastly, the computer 100 controls the printer 200 by the color print module 48 and printing of the halftone-processed color region (step S108).

The above-described printing system 10 according to the present embodiment performs the printing of the metallic region by the dot concentration type metallic dot such that the printing medium is exposed as the base prior to the printing of the color region, when the image data including the metallic region is printed. Accordingly, although the metallic region and the color region are superposed in the image, (at least a portion of) the dots of the color ink is formed in a portion in which the base of the metallic region are exposed. As a result, even when the metallic region and the color region are superposed, the damage of the color development of the color ink or the glossy feeling of the metallic color is suppressed. In addition, according to the present embodiment, since the dots of the color inks are formed on the base between the metallic dots, the scratch resistance of the color ink does not significantly deteriorate even when the metallic region and the color region are superposed.

D. EXAMPLES

Hereinafter, the detailed example of the metallic region printed by the dot concentration type metallic dot will be described.

(D1) First Example

Figure 5:
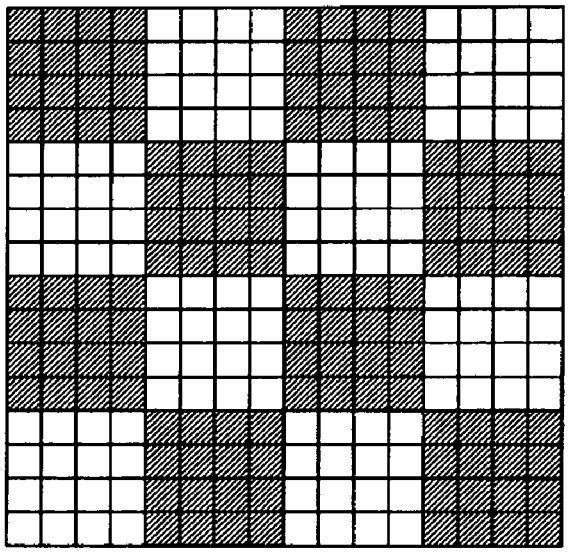
FIG. 5 is a view explaining a first example of a dot concentration type metallic dot.

FIG. 5 is a view explaining a first example of a dot concentration type metallic dot. Each of lattices of the drawing denotes a minimum size of a dot which can be formed on the printing medium by the printer 200. A hatched portion shown in the drawing denotes a portion in which the dot is formed by the metallic ink.

As shown in FIG. 5, in the present example, the metallic region is formed such that rectangular halftone dots configured by concentrating a plurality of dots are connected in four directions at an angle 45°. In the example shown in FIG. 5, an example in which each halftone dot and the base portion between the halftone dots have the same area such that the metallic region having an average concentration of 50% is printed is shown.

(D2) Second Example

Figure 6:
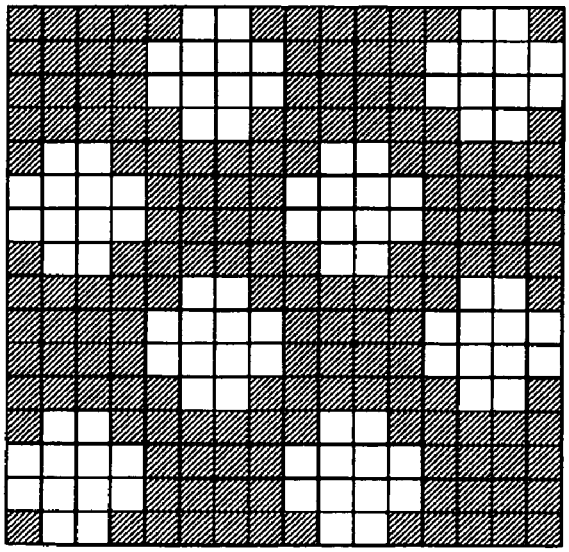
FIG. 6 is a view explaining a second example of a dot concentration type metallic dot.

FIG. 6 is a view explaining a second example of a dot concentration type metallic dot. As shown in FIG. 6, in the present example, the metallic region is formed such that circular bases are arranged at an angle of 45°. In the metallic region shown in FIG. 6, since the metallic portion occupies a larger area than that of the base portion, the average concentration of the metallic region is 50% or more.

(D3) Third Example

Figure 7:
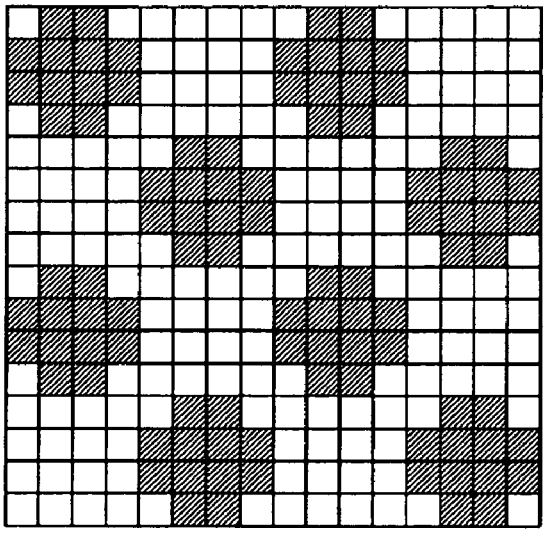
FIG. 7 is a view explaining a third example of a dot concentration type metallic dot.

FIG. 7 is a view explaining a third example of a dot concentration type metallic dot. As shown in FIG. 7, in the present example, the metallic region is formed such that circular halftone dots configured by concentrating a plurality of dots are arranged at an angle of 45°. In the metallic region shown in FIG. 7, since the base portion occupies a larger area than that of the metallic portion, the average concentration of the metallic region is 50% or less.

(D4) Fourth Example

Figure 8:
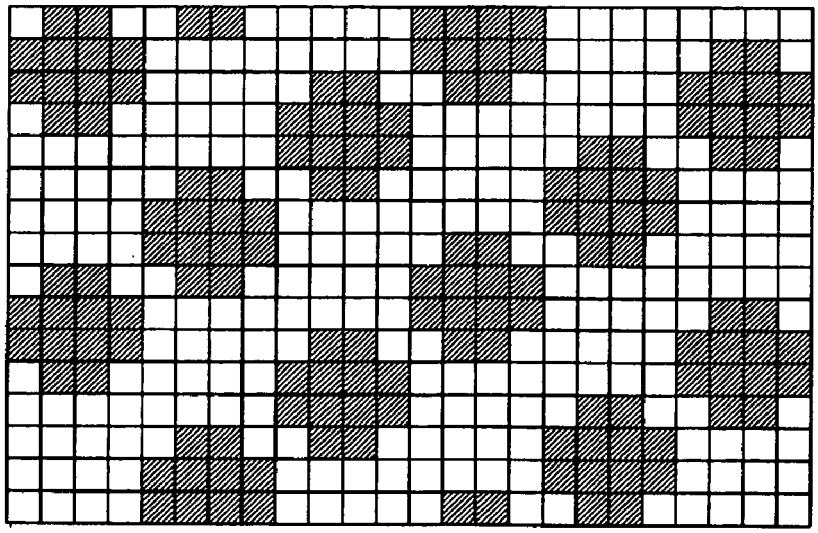
FIG. 8 is a view explaining a fourth example of a dot concentration type metallic dot.

FIG. 8 is a view explaining a fourth example of a dot concentration type metallic dot. FIG. 8 shows an example in which the metallic region is formed such that circular halftone dots are arranged at a predetermined angle other than 45°. The dot concentration type halftone dots may be arranged at any angle, instead of 45°.

(D5) Fifth Example

Figure 9:
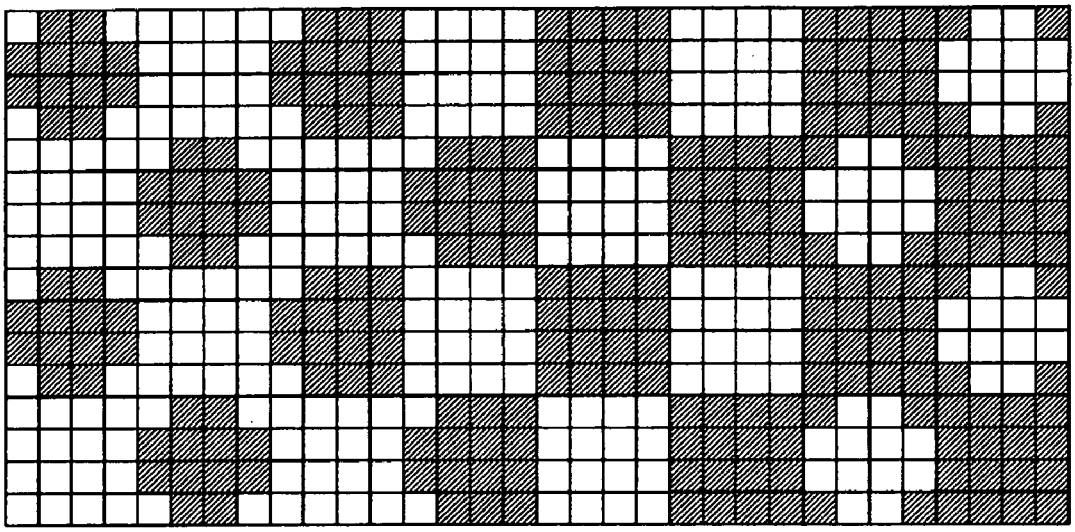
FIG. 9 is a view explaining a fifth example of a dot concentration type metallic dot.

FIG. 9 is a view explaining a fifth example of a dot concentration type metallic dot. FIG. 9 shows an example in which the shape of the metallic dot is changed in the metallic region. Circular metallic dots are formed on the left side of the metallic region shown in FIG. 9, and rectangular metallic dots are formed on the central portion thereof. In addition, metallic portions are formed such that circular bases are exposed on the right side. That is, the metallic region is formed such that the concentration of the metallic color is increased from the left side to the right side. By changing the metallic concentration in the metallic region, portions having different glossy feelings can be formed in the same metallic region.

The metallic concentration in the metallic region can be, for example, adjusted according to the concentration of the color region which is printed so as to be superposed on the metallic region. That is, when the metallic region is printed in the step S106 of the above-described printing process, the ink concentration of the color region superposed on the position where the metallic dots are formed is read from the halftone-processed image by the step S104, and this ink concentration and a predetermined condition are compared. For example, if the read concentration of the color ink is higher than the predetermined concentration, the metallic concentration of that portion is decreased and, if the concentration of the color ink is lower than the predetermined concentration, the metallic concentration of that portion is increased. By performing such a process, it is possible to improve the color development of both regions, even when the metallic region and the color region are superposed.

(D6) Sixth Example

Figure 10:
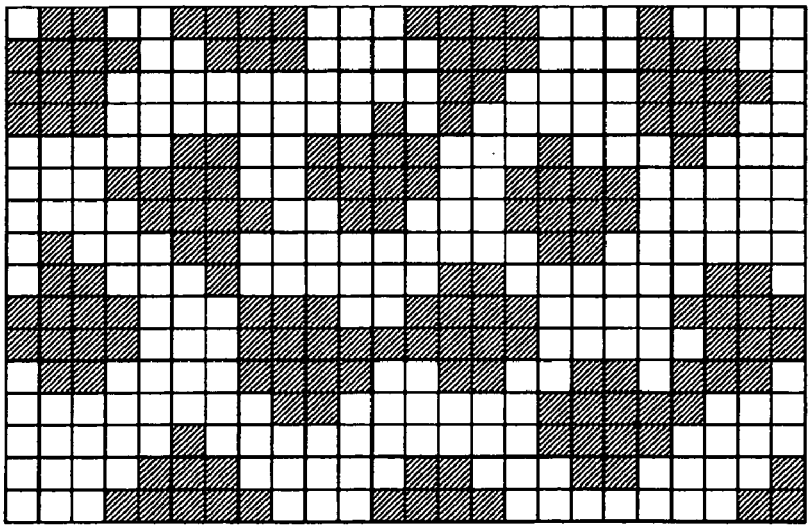
FIG. 10 is a view explaining a sixth example of a dot concentration type metallic dot.

FIG. 10 is a view explaining a sixth example of a dot concentration type metallic dot. In the example shown in FIG. 10, an example in which metallic dots having irregular shapes and a spatial frequency having green noise characteristics are formed in the metallic region is shown. Such metallic dots may be formed by using a dither matrix for outputting characteristics in which a high frequency component and a low frequency component are low and an intermediate frequency component is high. When the metallic dots having irregular shapes are formed, it is possible to suppress the generation of a periodical shape in the metallic region due to the mechanistic factor of the printer 200 or the generation of moiré due to a relationship with the halftone-processed color region.

(D7) Seventh Example

Figure 11:
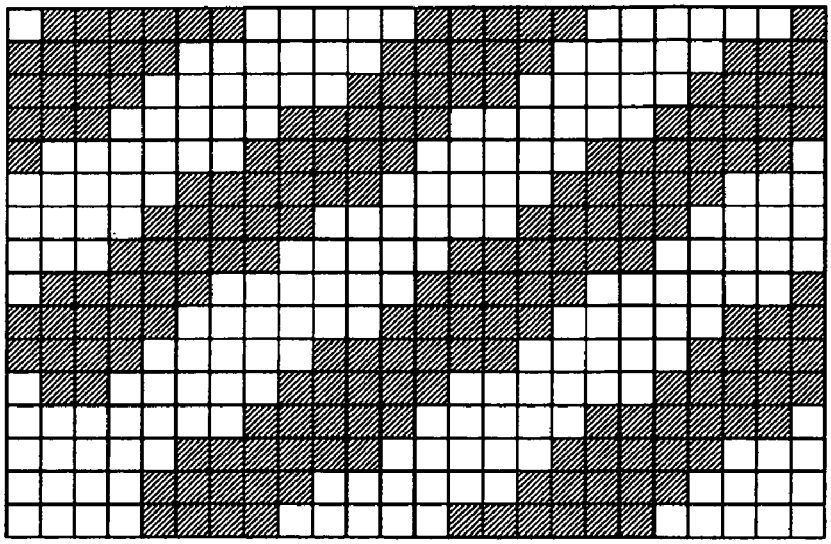
FIG. 11 is a view explaining a seventh example of a dot concentration type metallic dot.

FIG. 11 is a view explaining a seventh example of a dot concentration type metallic dot. In the example shown in FIG. 11, a linear region is formed by a plurality of metallic dots and the linear region is continuously arranged in parallel such that a stripe-shaped metallic region is formed. In the example shown in FIG. 11, although the angle of the stripe is approximately 40°, the angle may be arbitrarily adjusted and the stripe may be formed in a vertical direction or a horizontal direction. In addition, a gap between the stripes may be arbitrarily adjusted.

(D8) Eighth Example

Figure 12:
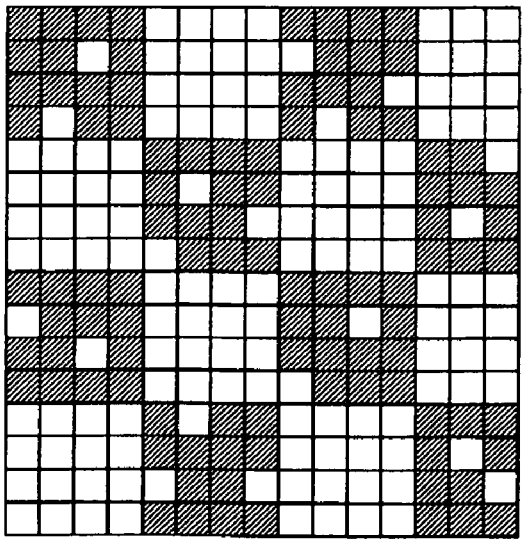
FIG. 12 is a view explaining an eighth example of a dot concentration type metallic dot.

FIG. 12 is a view explaining an eighth example of a dot concentration type metallic dot. In the example shown in FIG. 12, rectangular halftone dots configured by concentrating a plurality of dots are connected in four directions at an angle of 45°, and the dots in the halftone dots are randomly thinned so as to form gaps. Although the dots in the halftone dots are thinned, when the metallic ink is actually ejected on the printing medium, the metallic ink is embedded in the thinned portions for a dot gain. By this configuration, it is possible to reduce the use amount of the metallic ink and suppress the overflow or bleeding of the ink. In addition, in either of the above-described examples, the dots may be thinned like the present example. The thinning of the dots may be, for example, realized by previously generating a mask obtained by subtracting dots having blue noise characteristics from a mask of the halftone dots and applying this mask to the metallic region.

E. PRINTING EXAMPLE OF COLOR INK

Figure 13:
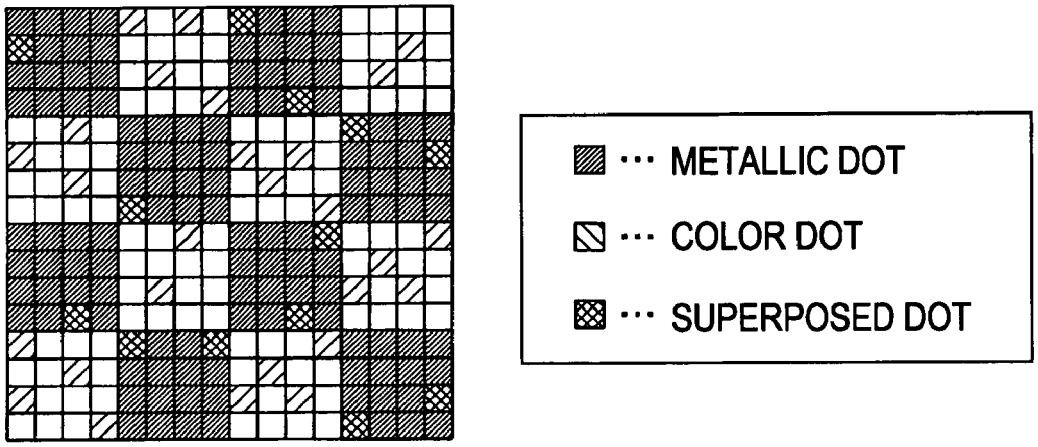
FIG. 13 is a view showing an example of forming dot dispersion type color dots on a metallic region.
Figure 14:
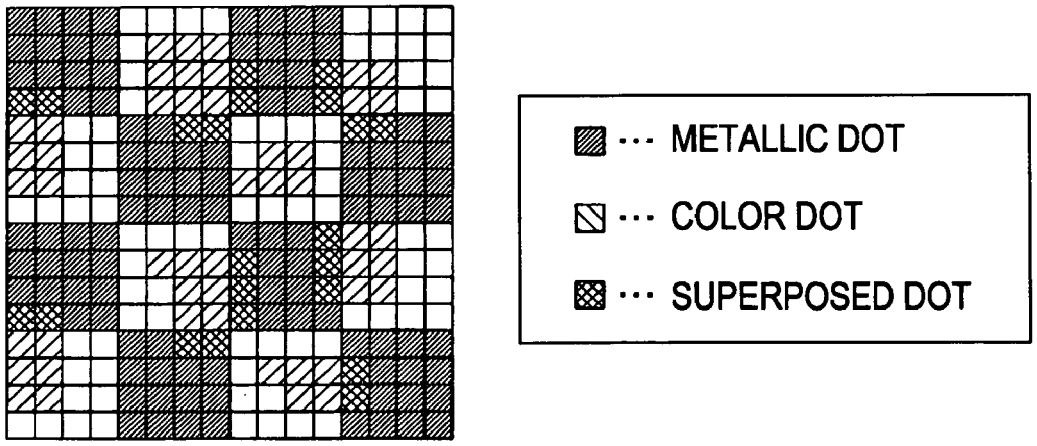
FIG. 14 is a view showing an example of forming dot concentration type color dots on a metallic region.

FIGS. 13 and 14 are views showing examples in which the image of the color region is printed on the metallic region shown in the first example (FIG. 5) using the color ink. FIG. 13 shows an example of forming the color region by dot dispersion type dots and FIG. 14 shows an example of forming the color region by dot concentration type dots. As shown in these drawings, when the color region is formed by the dot dispersion type dots or the dot concentration type dots after the metallic region is formed by the dot concentration type metallic dots, a portion of the color dots is ejected on the metallic region, but the other portion thereof is ejected on the base portion exposed from the metallic region. Accordingly, even when the metallic region and the color region are superposed, it is possible to suppress the damage of the color development of the color ink or the glossy feeling of the metallic color and suppress the deterioration of the scratch resistance of the color ink. Such effects are the same even when the color ink is the pigment-based ink or the dye-based ink.

Although the color ink is allowed to be ejected on the metallic ink in the printing example shown in FIGS. 13 and 14, the control may be performed such that the color ink is ejected on only the base portion except the metallic ink portion.

Although the embodiment and the various examples of the invention are described, the invention is not limited to the embodiment and the examples and various configurations can be taken without departing from the range of the invention.

For example, in the above-described embodiment, in the printing system 10 including the computer 100 and the printer 200, the printing using the metallic ink is performed. In contrast, the printer 200 may receive the image data from the digital camera or various types of memory cards and perform the printing using the metallic ink. That is, the CPU of the control circuit 260 of the printer 200 may perform the same process as the above-described printing process and perform the printing using the metallic ink.

The printing system 10 according to the above-described embodiment may select a metallic region to be formed according to any one of the above-described examples in a setup screen of the printer driver 24. At this time, the concentration of the metallic ink may be allowed to be input such that the average concentration of the metallic region, that is, the size of the metallic dot, is set according to this concentration.

What is claimed is:

1. A printing device which prints an image using a metallic ink and a color ink, the device comprising:

an input unit which inputs image data;

a metallic dot formation unit which forms dot concentration dots on a printing medium using the metallic ink;

and a color print unit which prints the image indicated by the image data using the color ink on the printing medium on which the dots using the metallic ink are formed.

2. The printing device according to claim 1, wherein the metallic dot formation unit prints halftone dots as the dot concentration dots.

3. The printing device according to claim 1, wherein the metallic dot formation unit prints dots having green noise characteristics as the dot concentration dots.

4. The printing device according to claim 1, wherein the metallic dot formation unit changes a size of each of the dot concentration dots according to a predetermined condition.

5. The printing device according to claim 4, wherein the metallic dot formation unit changes the size of each of the dot concentration dots according to a color tone of the color ink printed at position where the dots are formed.

6. The printing device according to claim 1, wherein the metallic dot formation unit forms the dot concentration dots at a predetermined gap therein.

7. The printing device according to claim 1, wherein the metallic dot formation unit forms the dot concentration type dots by ejecting ink droplets of the metallic ink on the printing medium.

8. A printing method which prints an image using a metallic ink and a color ink by a printing device, the method comprising:

inputting image data;

forming dot concentration dots on a printing medium using the metallic ink; and printing the image indicated by the image data using the color ink on the printing medium on which the dots using the metallic ink are formed.

9. A computer program product which prints an image using a metallic ink and a color ink, the program realizing:

on a computer, an input function of inputting image data;

a metallic dot formation function of forming dot concentration dots on a printing medium using the metallic ink; and a color print function of printing the image indicated by the image data using the color ink on the printing medium on which the dots using the metallic ink are formed.

10. A computer-readable recording medium comprising a computer program of the computer program product according to claim 9 recorded thereon.

11. The computer readable recording medium of claim 10, wherein the computer-readable recording medium is a tangible recording medium.

12. A printing device which prints an image using a metallic ink and a color ink, the device comprising:

an interface which inputs image data;

metallic dot ejection heads that form dot concentration dots on a printing medium using the metallic ink; and color ejection heads that print the image indicated by the image data using the color ink on the printing medium on which the dots using the metallic ink are formed.

* * * * *